US005333545A

United States Patent [19]

Ganter et al.

[11] Patent Number: 5,333,545

[45] Date of Patent: Aug. 2, 1994

[54] SHEET-FED ROTARY OFFSET PRINTING PRESS WITH A REMOVABLE IMPRINTING OR FINISHING UNIT

[75] Inventors: Udo Ganter, Hirschbeg-Leutershausen; Norbert Rodi, Kronau, both of Fed. Rep. of Germany

[73] Assignee: Heidelberger Druckmaschinen AG, Heidelberg, Fed. Rep. of Germany

[21] Appl. No.: 72,524

[22] Filed: Jun. 4, 1993

[30] Foreign Application Priority Data

Jun. 4, 1992 [DE] Fed. Rep. of Germany ..... 4218422

[51] Int. Cl.[5] ..... B41F 5/02

[52] U.S. Cl. ..... 101/76; 101/217; 101/248; 101/230

[58] Field of Search ..... 101/212, 216, 217, 219, 101/224, 76, 132, 141, 142, 232, 248, 183, 230, 178

[56] References Cited

U.S. PATENT DOCUMENTS

| | | | |
|---|---|---|---|
| 3,728,960 | 4/1973 | Heath | 101/76 |
| 4,024,812 | 5/1977 | Jahn | 101/76 |
| 4,262,590 | 4/1981 | Bruckner | 101/76 |
| 4,346,656 | 8/1992 | Schwaab et al. | 101/228 |
| 4,369,703 | 1/1983 | Jarach | 101/76 |
| 4,426,929 | 1/1984 | Fujisawa et al. | 101/76 |
| 4,572,069 | 2/1986 | Schwarzbeck | 101/76 |
| 4,756,245 | 7/1988 | Roch | 101/227 |
| 4,833,988 | 5/1989 | Sugiyama et al. | 101/247 |
| 4,848,265 | 7/1989 | Komori | 101/216 |
| 4,930,414 | 6/1990 | Wirz | 101/183 |
| 4,936,214 | 6/1990 | Overholser | 101/142 |
| 4,967,659 | 11/1990 | Goodwin et al. | 101/76 |
| 5,168,809 | 12/1992 | Becker | 101/230 |
| 5,178,678 | 1/1993 | Koehler et al. | 101/178 |
| 5,213,035 | 5/1993 | Becker | 101/230 |

FOREIGN PATENT DOCUMENTS

| | | |
|---|---|---|
| 0040183 | 11/1981 | European Pat. Off. . |
| 2221343 | 11/1973 | Fed. Rep. of Germany . |
| 3006100 | 12/1980 | Fed. Rep. of Germany . |
| 2945192 | 5/1981 | Fed. Rep. of Germany . |
| 3717093 | 12/1988 | Fed. Rep. of Germany . |
| 2853901 | 6/1990 | Fed. Rep. of Germany . |
| 63-180260 | 11/1988 | Japan . |
| 1589266 | 5/1981 | United Kingdom . |
| 2158774 | 12/1985 | United Kingdom . |

*Primary Examiner*—Eugene H. Eickholt

*Attorney, Agent, or Firm*—Herbert L. Lerner; Laurence A. Greenberg

[57] ABSTRACT

Sheet-fed rotary offset printing press having a printing unit including a plate cylinder, a rubber-blanket cylinder and an impression cylinder double the size of the plate and the rubber-blanket cylinders, respectively, at least one auxiliary unit selected from an imprinting unit and a finishing unit removably disposed on a tool-carrier shaft extending transversely to a sheet-transport direction and being mounted in a frame of the printing press, and drive elements for connecting the auxiliary unit to a drive for the printing press and for bringing the auxiliary unit into engagement with the sheet as it is being guided on the impression cylinder, comprising another tool-carrier shaft extending transversely to the sheet-transport direction and being mounted in a frame of the printing press, both of the tool-carrier shafts being disposed parallel to one another in the printing unit and offset from one another by a phase angle having a vertex on a central axis of the impression cylinder, and driving elements for the respective auxiliary unit disposed on each of the two tool-carrier shafts.

8 Claims, 3 Drawing Sheets

SHEET-FED ROTARY OFFSET PRINTING PRESS WITH A REMOVABLE IMPRINTING OR FINISHING UNIT

SPECIFICATION

The invention relates to a sheet-fed rotary offset printing press having a printing unit including a plate cylinder, a rubber-blanket cylinder and an impression cylinder, at least one auxiliary unit selected from an imprinting unit and a finishing unit removably disposed on a tool-carrier shaft extending transversely to a sheet-transport direction and being mounted in a frame of the printing press, and drive elements for connecting the auxiliary unit to a drive for the printing press and for bringing the auxiliary unit into engagement with the sheet as it is being guided on the impression cylinder.

Printing presses of such a construction with an impression cylinder for accommodating thereon a single-size or single-format sheet, and a removable inking unit for a numbering mechanism disposed on the tool-carrier shaft conform to the practical state of the art and are diagrammatically represented, for example, in the publication VS 3.20/087, HEIDELBERGER DRUCKMASCHINEN AG. A permanently installed numbering unit with a removable inking unit for ink numbering has become known heretofore from German Published Non-Prosecuted Patent Application (DE-OS) 22 21 343. By means of an exchangeably arranged imprinting or finishing unit, it is possible, without any additional working operation, for the sheets which have been printed in the printing unit of the printing press to be either numbered, perforated, varnished or otherwise processed. Such a removable numbering mechanism for ink numbering has become known heretofore also from the published European Patent Document 0 040 183 B1. Considerable problems are posed in housing the imprinting or finishing units in the tight space near the impression cylinder and between the rubber-blanket cylinder, on the one hand, and the delivery chain, on the other hand.

Heretofore known from published German Patent Documents 29 45 192 A1 and 30 06 100 A1 is a removable numbering unit for ink numbering printed sheets, the removable numbering unit having its own impression cylinder for a numbering box disposed in a further cylinder, so that when the numbering unit is used, it is necessary for the sheet delivery to be displaced. According to the publication RYOBI 520/522/522PF of RYOBI Ltd., Fuchu, Hiroshima, Japan, such a numbering unit or the like is disposed in its own frame and, when required, is connected to the printing press. Such an arrangement calls for a separate sheet delivery and, therefore, has a very elaborate construction.

None of the aforedescribed hitherto known arrangements permits the performance simultaneously of a plurality of follow-up processing operations on the printed sheets directly in an offset printing press without additional operating steps being necessary.

From the published German Patent Document 37 17 093 A1 and other publications, rotary offset printing presses for printing on cardboard have also become known heretofore, the rotary offset printing presses having a so-called double-size or double-format impression cylinder in order, thereby, to avoid stresses resulting from pronounced curvature of the stock to be printed on, particularly when printing on very thick and/or very stiff stock.

Conversely, it is an object of the invention to provide a sheet-fed rotary printing press with a removable imprinting or finishing unit which, with low-cost construction and without entailing any additional operating steps, permits the performance of a plurality of selectively variable follow-up processing operations directly on the sheets as the sheets are printed in the rotary offset printing press.

It is, accordingly, an object of the invention to provide a sheet-fed rotary offset printing press having a printing unit including a plate cylinder, a rubber-blanket cylinder and an impression cylinder double the size of the plate and the rubber-blanket cylinders, respectively, at least one auxiliary unit selected from an imprinting unit and a finishing unit removably disposed on a tool-carrier shaft extending transversely to a sheet-transport direction and being mounted in a frame of the printing press, and drive elements for connecting the auxiliary unit to a drive for the printing press and for bringing the auxiliary unit into engagement with the sheet as it is being guided on the impression cylinder, comprising another tool-carrier shaft extending transversely to the sheet-transport direction and being mounted in a frame of the printing press, both of the tool-carrier shafts being disposed parallel to one another in the printing unit and offset from one another by a phase angle having a vertex on a central axis of the impression cylinder, and driving elements for the respective auxiliary unit disposed on each of the two tool-carrier shafts.

What is achieved thereby is that, due to the double-size or double-format impression cylinder of the main printing unit of the printing press, it is possible to accommodate two tool-carrier shafts with separate driving elements for driving different imprinting or finishing tools which may be exchangeably disposed on the tool-carrier shafts. This permits the arrangement of block holders, numbering units, perforating tools or the like on the tool-carrier shafts and the separate drive thereof in accordance with the working cycle of the printing press. A considerable advantage of the construction according to the invention is that these processing operations may occur simultaneously on the press-side impression cylinder as the sheets are being printed. The tools can be readily mounted or assembled at an accessible location. The modifications of the printing press required for this purpose can be provided in a structurally simple and sturdy manner.

Each tool-carrier shaft is advantageously associated with its own switching shaft so as to permit switching operations, for example, for digit selection in numbering units, in a tool on each of the two tool-carrier shafts. Preferably, they are actuated in a conventional manner by controllable pneumatic cylinders.

In accordance with another feature of the invention, the sheet-fed rotary offset printing press includes a cross-member disposed parallel to the two tool-carrier shafts, and longitudinal perforating knives adjustably and detachably mounted on the cross-member. This provides a further improvement in flexibility with regard to equipping the two tool-carrier shafts so as to optimize the printing process, because longitudinal perforations can be effected by perforating knives which are detachably and adjustably mounted on the cross-member.

In accordance with a further feature of the invention, the cross-member is swivelably disposed in the printing-press frame. Thus, the cross-member is advantageously able to swivel about its longitudinal axis, so that the tools, such as perforating knives or the like, disposed on the cross-member can be brought into engagement with the impression cylinder, by a swiveling motion of the cross-member in a given direction, and can be brought out of engagement, by a swiveling motion of the cross-member in the opposite direction.

In accordance with an added feature of the invention, the cross-member is rotatably mounted and is drivable in time with a working cycle of the printing press for lifting the longitudinal perforating knives cyclically from the circumference of the double-size impression cylinder.

In accordance with a concomitant feature of the invention, the sheet-fed rotary offset printing press includes a respective switching shaft with a stepping drive operatively associated with and disposed adjacent to each of the tool-carrier shafts.

In printing presses with a plurality of in-line printing units and double-size impression cylinders, it is further possible to provide one or more additional printing units with a tool-carrier shaft for an imprinting or finishing unit, so that the sought-after high degree of flexibility in the equipping of the tool-carrier shafts with auxiliary tools, such as imprinting or finishing units, is even further increased.

Other features which are considered as characteristic for the invention are set forth in the appended claims.

Although the invention is illustrated and described herein as embodied in a sheet-fed rotary offset printing press having a removable imprinting or finishing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
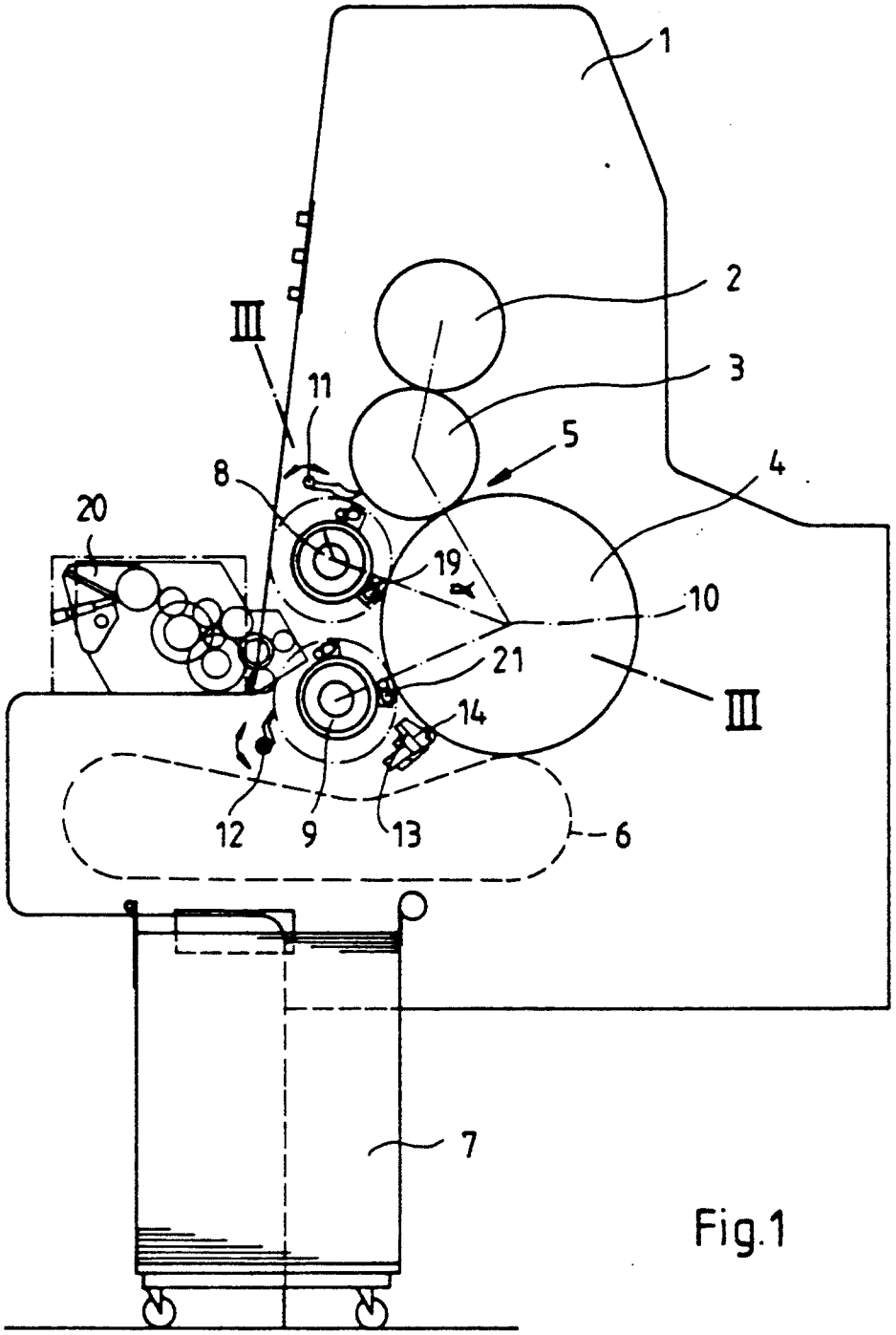
FIG. 1 is a diagrammatic side elevational view of a sheet-fed rotary offset printing press incorporating a first embodiment of the structural features according to the invention.

Referring now to the drawings and, first, particularly to FIG. 1 thereof, there is shown therein a plate cylinder 2, which has been inked by a non-illustrated inking unit, a rubber-blanket cylinder 3 and, cooperating with the latter, an impression cylinder 4 rotatably journalled in side walls of a frame 1 and driven in common by a lateral gear train, which is likewise not shown in the drawings. Compared with the plate cylinder 2 and the rubber-blanket cylinder 3, the impression cylinder 4 has a double the diameter and consequently can accommodate double the sheet size or format on the surface thereof. A sheet guided from the impressions cylinder 4 into a printing nip 5 is transferred to gripper systems of a delivery chain 6 and is transported over a delivery pile 7. Disposed in a sheet-guiding region of the double-size impression cylinder 4 are two tool-carrier shafts 8 and 9 disposed parallel to one another and offset from one another by a phase angle $\alpha$ with reference to a center line or axis 10 of the impression cylinder 4. Both tool-carrier shafts 8 and 9 are rotatably supported at the ends thereof in the side walls of the frame 1 and are each in engagement with separate driving elements which are connectible, in turn, with driving elements of the printing-press drive. Each of the two tool-carrier shafts 8 and 9 is associated with a respective switching shaft 11 and 12, which have a drive by which, it is possible in a conventional manner to effect a selection of appropriate digits in numbering units or the like. Furthermore, disposed below the double-size impression cylinder and the lower tool-carrier shaft 9 is a cross-member 13 on which, for example, longitudinally perforating knives 14 are mounted in a laterally adjustable and detachable manner. The cross-member 13 may, if necessary, be swivelled in order to bring tools on the cross-member 13 into and out of engagement.

It is also possible, however, for the cross-member 13 to be rotatably mounted and to be driven in time with the working cycle of the printing press in order to perform periodically recurring processing operations. It is likewise possible to combine a rotary drive with the swiveling arrangement for bringing the tools into and out of engagement.

Figure 3:
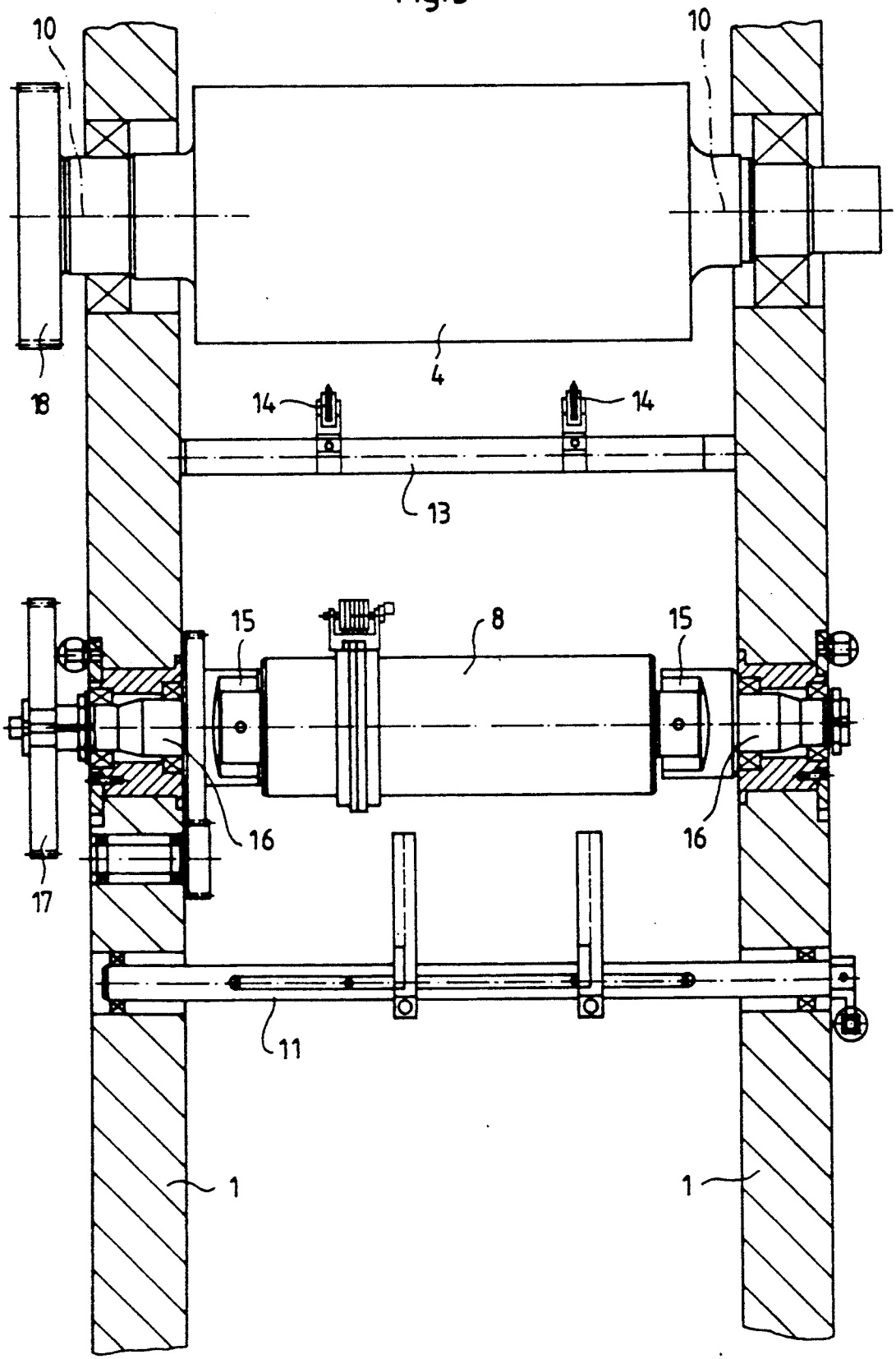
FIG. 3 is a reduced cross-sectional view of FIG. 1 taken along the line III—III.

The sectional view in FIG. 3 shows a construction for the mounting of the tool-carrier shaft 8 and 9, respectively, in the side walls of the frame 1. According to this representation, the tool-carrier shaft is insertable, by quick-action coupling elements provided at its ends, into complementary coupling elements 15 on the inner ends of bearing journals 16 which are mounted in the side walls of the frame 1. In the interest of improved clarity, the tool-carrier shaft itself is not shown in FIG. 3. A driving gearwheel 17 on one of the bearing journals 16 permits a connection to a gearwheel 18 of the gear train for driving the printing press.

By equipping the tool-carrier shafts 8 and 9 in the manner shown in FIG. 1, a longitudinal perforation, for example, may be effected by longitudinal perforating knives 14 on the cross-member 13, and also a numbering, as well as a transverse perforation of the printed sheets may also be performed directly on the impression cylinder of the offset printing unit in one single operation. The transverse perforating knives 19 are disposed on the tool-carrier shaft 8. The switching shaft 11 is thus out of operation. An imprint inking unit 20 supplies ink to the numbering unit 21, which is disposed on the tool-carrier shaft 9. The switching shaft 12 selects the digits of the numbering unit.

Figure 2:
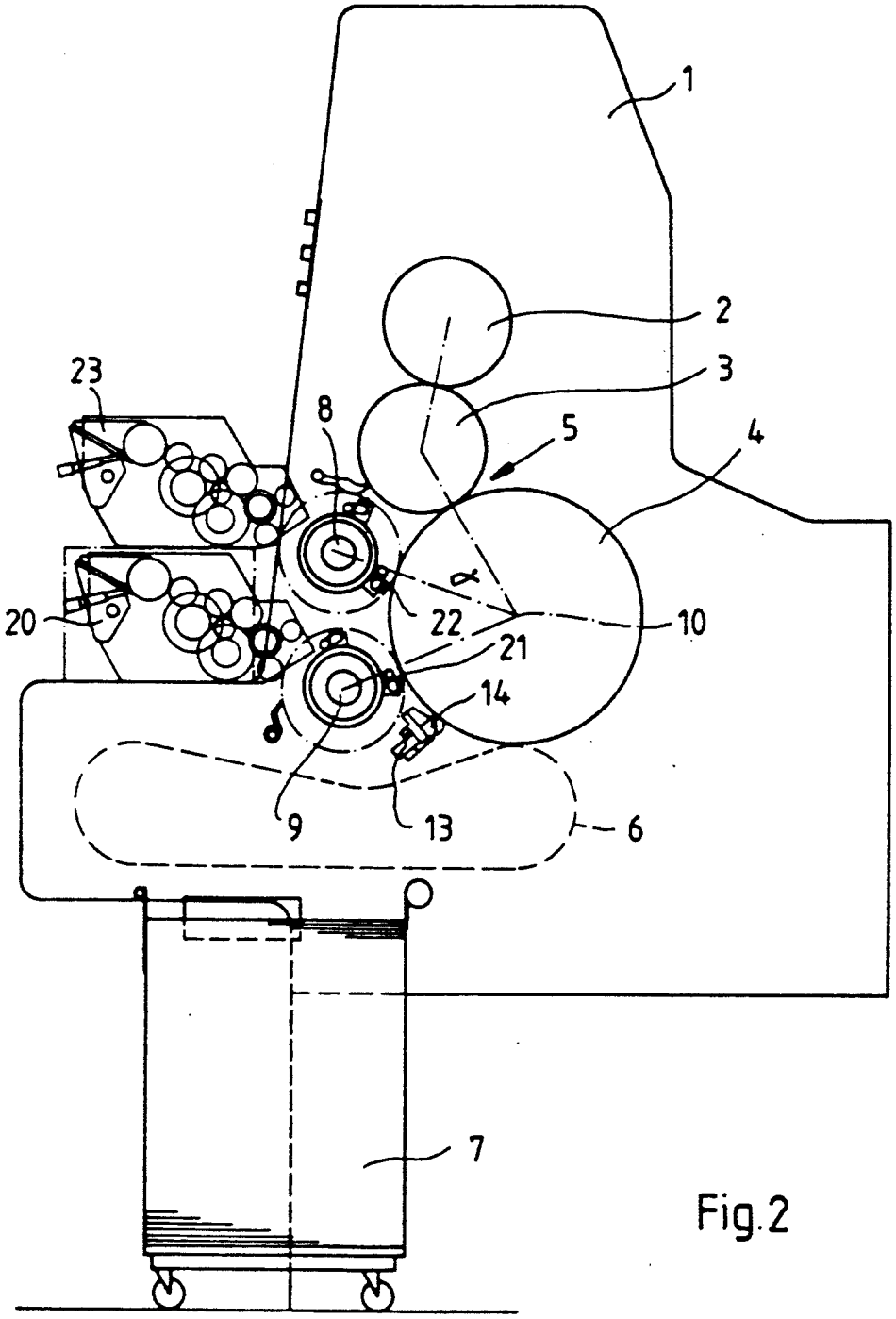
FIG. 2 is a view like that of FIG. 1, but wherein a second embodiment of the structural features is incorporated in the printing press.

In the embodiment of the invention shown in FIG. 2, instead of the transverse perforating knives 19, the tool-carrier shaft 8 is equipped with block holders 22 which are supplied with ink from a block-inking unit 23. It is thereby possible to imprint a decorative ink or to apply varnish. The manner in which the tool-carrier shaft 9 is equipped is identical to that described hereinbefore with reference to FIG. 1. Longitudinal perforating knives 14 are adjustably and detachably mounted on the cross-member 13. The cross-member 13 is rotatably mounted and is connectible to the printing-press drive, so that the perforating knives are lifted off the impression cylinder in a cyclical manner, so that they do not damage the grippers on the impression cylinder. Independent perforating across the entire width of the paper size or format is thereby permitted.

In the embodiments of the invention shown in FIGS. I and 2, the two tool-carrier shafts, in conjunction with a double-size impression cylinder, offer a multiplicity of possible combinations for the follow-up processing of a sheet which has been printed in a rotary offset printing unit, such follow-up processing occurring directly on the impression cylinder of the same printing unit or of one or more other printing units during the printing process.

The foregoing is a description corresponding in substance to German Application P 42 18 422.3, dated Jun. 4, 1992, the International priority of which is being claimed for the instant application, and which is hereby made part of this application. Any material discrepancies between the foregoing specification and the aforementioned corresponding German application are to be resolved in favor of the latter.

We claim:

1. Sheet-fed rotary offset printing press having a printing unit including a plate cylinder, a rubber-blanket cylinder and an impression cylinder double the size of the plate and the rubber-blanket cylinders, respectively, at least one auxiliary unit selected from an imprinting unit and a finishing unit removably disposed on a tool-carrier shaft extending transversely to a sheet-transport direction and being mounted in a frame of the printing press, and drive elements for connecting the auxiliary unit to a drive for the printing press and for bringing the auxiliary unit into engagement with the sheet as it is being guided on the impression cylinder, comprising another tool-carrier shaft extending transversely to the sheet-transport direction and being mounted in a frame of the printing press, both of the tool-carrier shafts being disposed parallel to one another in the printing unit and offset from one another by a phase angle having a vertex on a central axis of the impression cylinder, and driving elements for the respective auxiliary unit disposed on each of the two tool-carrier shafts.

2. Sheet-fed rotary offset printing press according to claim 1, including a cross-member disposed parallel to the two tool-carrier shafts, and longitudinal perforating knives (14) adjustably and detachably mounted on said cross-member.

3. Sheet-fed rotary offset printing press according to claim 2, wherein said cross-member is swivelably disposed in the printing-press frame.

4. Sheet-fed rotary offset printing press according to claim 2, wherein said cross-member is rotatably mounted and is drivable in time with a working cycle of the printing press for lifting the longitudinal perforating knives cyclically from the circumference of the double-size impression cylinder.

5. Sheet-fed rotary offset printing press according to claim 1, including a respective switching shaft with a stepping drive operatively associated with and disposed adjacent to each of the tool-carrier shafts.

6. Sheet-fed rotary offset printing press according to claim 1, including a cross-member disposed parallel to the two tool-carrier shafts, and means mounted on said cross-member for applying fluid material to the sheet.

7. Sheet-fed rotary offset printing press according to claim 6, wherein said fluid material is decorative ink.

8. Sheet-fed rotary offset printing press according to claim 6 wherein said fluid material is varnish.

* * * * *